US011766377B2

(12) United States Patent
Doyle

(10) Patent No.: US 11,766,377 B2
(45) Date of Patent: Sep. 26, 2023

(54) PLATFORM-LIFT WALKER

(71) Applicant: Gabriela Doyle, Nogales, AZ (US)

(72) Inventor: Gabriela Doyle, Nogales, AZ (US)

( * ) Notice: Subject to any disclaimer, the term of this patent is extended or adjusted under 35 U.S.C. 154(b) by 294 days.

(21) Appl. No.: 17/408,314

(22) Filed: Aug. 20, 2021

(65) Prior Publication Data

US 2022/0062088 A1 Mar. 3, 2022

Related U.S. Application Data

(60) Provisional application No. 63/072,097, filed on Aug. 29, 2020.

(51) Int. Cl.
*A61H 3/04* (2006.01)

(52) U.S. Cl.
CPC ..... *A61H 3/04* (2013.01); *A61H 2003/046* (2013.01)

(58) Field of Classification Search
CPC ..... A61H 3/04
See application file for complete search history.

(56) References Cited

U.S. PATENT DOCUMENTS 4,907,794 A * 3/1990 Rose ..... A61H 3/04 280/43.24
6,318,392 B1 * 11/2001 Chen ..... A61H 3/04 280/47.35
6,338,493 B1 * 1/2002 Wohlgemuth ..... A61G 5/00 280/30
6,503,176 B2 * 1/2003 Kuntz ..... A61G 5/1018 482/68
6,659,478 B2 * 12/2003 Hallgrimsson ..... A61G 5/0883 280/643
7,568,712 B2 * 8/2009 Kovachi ..... A61H 3/04 280/87.051
9,039,040 B2 * 5/2015 Zhang ..... B62B 1/008 280/769
11,607,360 B2 * 3/2023 Vatti ..... A61G 7/1015
2002/0079663 A1 * 6/2002 Hallgrimsson ..... A61G 5/0891 280/87.041
2012/0104710 A1 * 5/2012 Liu ..... A61H 3/04 280/42
2017/0128299 A1 * 5/2017 Tsusaka ..... B25J 11/00

* cited by examiner

*Primary Examiner* — Noah Chandler Hawk

(74) *Attorney, Agent, or Firm* — Eugene Vamos

(57) ABSTRACT

The Platform-Lift Walker is a walker featuring a vertical driving platform that can lift objects from the ground while the user is standing. Similarly, the Platform-Lift Walker can lower objects to the ground while the user is standing. The Platform-Lift Walker offers users with balance or bending mobility issues an alternative to commercially available picker or grabber devices that are often difficult to use or unable to lift heavier objects. The Platform-Lift Walker includes a walker, a lifting mechanism, and a platform.

19 Claims, 12 Drawing Sheets

PLATFORM-LIFT WALKER

CROSS-REFERENCE TO RELATED APPLICATIONS

This application claims the priority benefit to U.S. Provisional Application 63/072,097 dated Aug. 29, 2020

STATEMENT REGARDING FEDERALLY SPONSORED RESEARCH/DEVELOPMENT

Not Applicable

THE NAMES OF THE PARTIES TO A JOINT RESEARCH AGREEMENT

Not Applicable

REFERENCE TO A "SEQUENCE LISTING," A TABLE, OR A COMPUTER PROGRAM

Not Applicable

STATEMENT REGARDING PRIOR DISCLOSURES BY AN INVENTOR OR JOINT INVENTOR

Not Applicable

BACKGROUND OF THE INVENTION

1 Field of Invention

The present invention, a lifting aide device, commerically known as the Tonee Lift, generally relates to the field of mobility aid devices.

2 Description of Related Art

There is a large segment of the population with bending or lifting limitations. These include patients who undergo corrective surgeries (e.g. spine, neck) who are often unable to bend or lift objects from the ground for many months or permanently. As people age, their abilities to reach down and grab items becomes limited. Commercially available picker or grabber devices on the market are often difficult to use or are unable to lift heavier objects for everyday household tasks.

According to a Georgetown University study, eight percent of all adults experience persistent or chronic back pain which limits their everyday activities. Chronic Back Pain, Health Policy Institute: Georgetown University, https://hpi-.georgetown.edu/backpain/# Additionally, the CDC reports that 24 million adults in the United States are limited in their activities due to arthritis. Arthritis, Centers for Disease Control and Prevention, https: cdc.gov/chronicdisease/resources/publications/factsheets/arthritis.htm Pain and stiffness in the knee, ankle and back can greatly limit people's abilities to kneel, bend and stoop. A lot of this pain and stiffness can be caused by the aforementioned chronic back pain or arthritis. Additionally, as people age the prevalence of stability issues or imbalance increases. A study (LIO) found that 14% of people 65 to 69 experience imbalance, 35% of people 70 to 84, and 46% of people older than 85 have these issues. There is a need for a device that offers a solution to these problems and will allow people to go about their day with greater ease and achieve more independence.

BRIEF DESCRIPTION OF THE INVENTION

The Platform-Lift Walker (100) is a walker featuring a vertical driving platform (500) that can lift objects (90) from the ground while the user is standing. Similarly, the Platform-Lift Walker (100) can lower objects (90) to the ground while the user is standing. The Platform-Lift Walker (100) offers users with balance or bending mobility issues an alternative to commercially available picker or grabber devices that are often difficult to use or unable to lift heavier objects.

The Platform-Lift Walker (100) comprises a walker (200), a lifting mechanism (400), and a platform (500). FIG. 9 shows the Platform-Lift Walker (100) comprising a walker (200), a lifting mechanism (400), and a platform (500).

The walker (200) supports the lateral and vertical forces that a user generates when utilizing the Platform-Lift Walker (100). The walker (200) allows for ergonomic handling and movement by the user. The walker (200) also provides attachment points for the other elements—the lifting mechanism (400) and the platform (500)—that allow for the lifting of objects (90). The walker (200) comprises a frame (210), two handles (350), two or more wheels (360), and two or more wheel locking systems (370). FIG. 9 shows the walker (200) comprising of a frame (210), two handles (350), four wheels (360), and two or more wheel locking systems (370).

A lifting mechanism (400) drives the platform (500) along vertically, raising or lowering the platform (500). The lifting mechanism (400) is attached to the frame (210) of the walker (200). The platform (500) is rotatably attached to the lifting mechanism (400).

The lifting mechanism (400) comprises one or more means for driving the platform along vertically (410), a prime mover (450), an energy storage device (460), a controller (470), and a plurality of sensors (480). The lifting mechanism (400) may further comprise a drive shaft (440). The drive shaft (440) operatively connects two or more means for driving the platform along vertically (410). When two or more means for driving the platform along vertically (410) are operatively connected, this allows force to be applied to multiple parts of the platform (500), allowing for a smoother movement. FIG. 9 shows a lifting mechanism (400) comprising of two means for driving the platform along vertically (410), a drive shaft (440), a prime mover (450) (not shown), an energy storage device (460), a controller (470), and a plurality of sensors (480) (not shown).

The platform (500) comprises a first side (502), a second side (504), a third side (506) and a fourth side (508). Objects (90) are placed over the platform (500). FIG. 5 shows a platform (500).

DETAILED DESCRIPTION OF THE INVENTION

Figure 1:
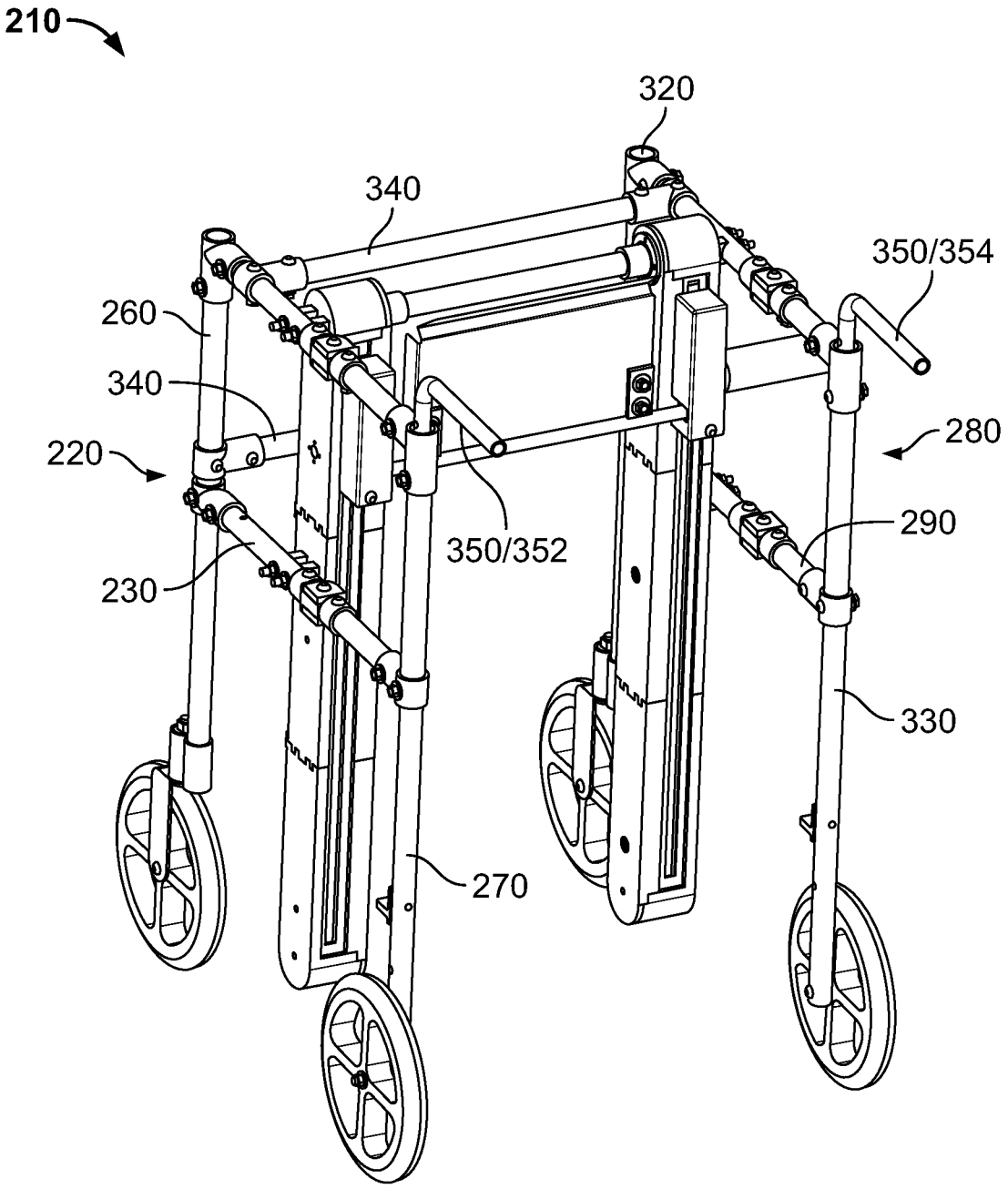
FIG. 1 is a perspective back view of the Platform-Lift Walker (100) with the platform (500) in a folded-up orientation

The Platform-Lift Walker (100) is a walker featuring a vertical driving platform (500), where objects (90) can be placed over the platform (90) so that the Platform-Lift Walker (100) can lift objects (90) from the ground while the user is standing. Similarly, the Platform-Lift Walker (100) can lower objects (90) to the ground while the user is standing. The Platform-Lift Walker (100) offers users with balance or bending mobility issues an alternative to commercially available picker or grabber devices that are often difficult to use or unable to lift heavier objects.

Because the Platform-Lift Walker (100) is designed for users with balance or bending mobility issues, foldability, portability, and functionality of the vertical driving platform (500) are key features. The Platform-Lift Walker (100) is designed to lift everyday household objects (90), typically up to 25 pounds, although the Platform-Lift Walker (100) may be design to lift heavier objects. The Platform-Lift Walker (100) is designed to lift everyday household objects (90) waist high, typically 30 to 36 inches so that the user can manipulate the object (90) with the option to place the object (90) over a raised surface such as a counter.

Figure 9:
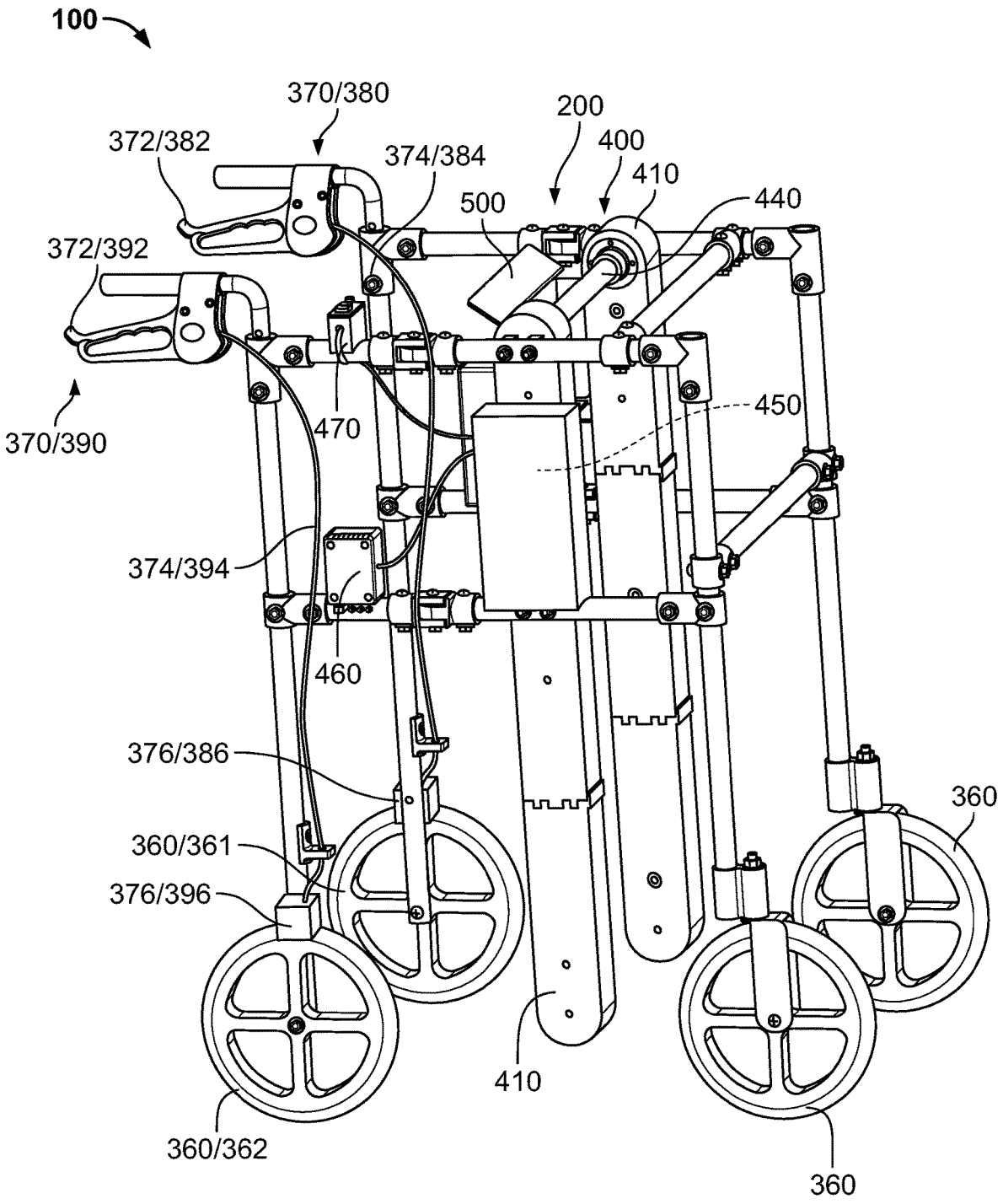
FIG. 9 is a side perspective view of the Platform-Lift Walker (100)

The Platform-Lift Walker (100) comprises a walker (200), a lifting mechanism (400), and a platform (500). FIG. 9 shows the Platform-Lift Walker (100) comprising a walker (200), a lifting mechanism (400), and a platform (500).

1 Walker (200)

The walker (200) supports the lateral and vertical forces that a user generates when utilizing the Platform-Lift Walker (100). The walker (200) allows for ergonomic handling and movement by the user. The walker (200) also provides attachment points for the other elements—the lifting mechanism (400) and the platform (500)—that allow for the lifting of objects (90).

The walker (200) comprises a frame (210), two handles (350), two or more wheels (360), and two or more wheel locking systems (370). FIG. 9 shows the walker (200) comprising of a frame (210), two handles (350), four wheels (360), and two or more wheel locking systems (370).

The walker (200) design has similar characteristics to those currently in the market, which includes front-wheel walkers. The choice of walker materials should be consistent to those currently in the market, having light weight qualities that allow an elderly or physically challenged user to easily use. For example, the walker (200) may be made out of aluminum and ABS so it is light enough to be picked up and moved easily. The walker (200) may have comfort grips made of foam, gel, or rubber to enhance the user's comfort. The walker (200) may be designed to be folded for storage purposes.

1.1 Frame (210)

The frame (210) is the super structure that supports the lateral and vertical forces that a user generates when utilizing the Platform-Lift Walker (100). The frame (210) provides attachment points to the other elements of the walker (200), mainly, the two or more wheels (360), and one or more wheel locking system (370). The frame may further comprise an imaginary central longitudinal plane (212-YZ).

The frame (210) may comprise a first side section (220), a second side section (280), and one or more cross bars (340). The first side section (220) and the second side section (280) provide lateral support and the one or more cross bars (340) attach the first side section (220) to the second side section (280). FIG. 1 shows the frame (210) of the walker (200) with a first side section (220) and a second side section (280).

The frame (210) is made out of light weight materials such as aluminum, carbon fiber, and ABS.

1.2 First Side Section (220)

The first side section (220) comprises one or more horizontal supports (230), a front vertical support (260) and a back vertical support (270).

The front vertical support (260) may comprise a top end (262) and a bottom end (264). The back vertical support (270) may comprise a top end (272) and a bottom end (274).

Figure 2:
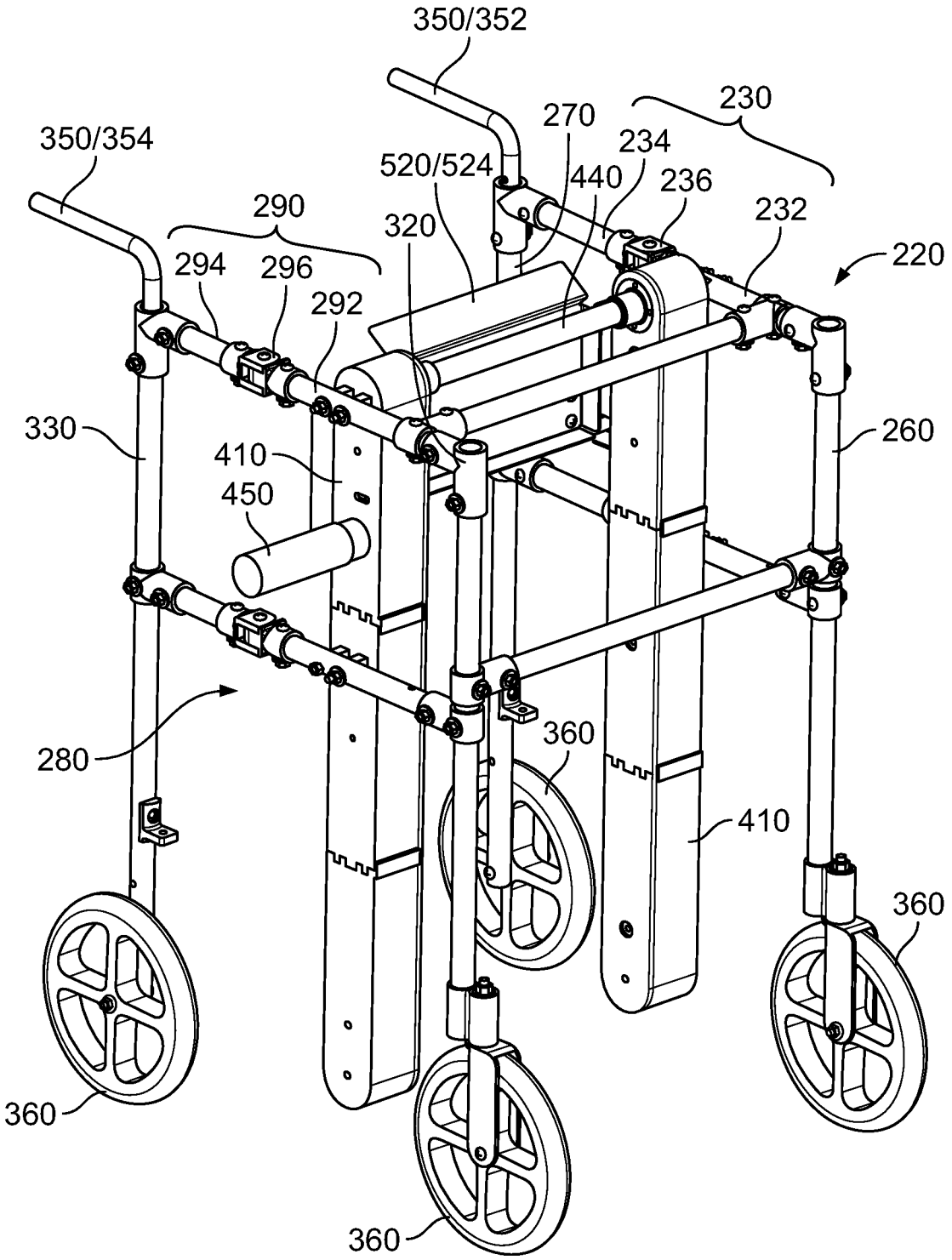
FIG. 2 is a perspective front view of the frame (210) with the first side section (220) and the second side section (280) in an extended configuration

The one or more horizontal supports (230) attach the front vertical support (260) to the back vertical support (270). Each of the one or more horizontal supports (230) comprises a locking articulated joint (236), a first part (232) and a second part (234). The first part (232) is attached to the locking articulated joint (236) and the front vertical support (260). The second part is attached to the locking articulated joint (236) and the back vertical support (270). FIG. 2 shows a first side section (220) with two horizontal supports (230).

Figure 3:
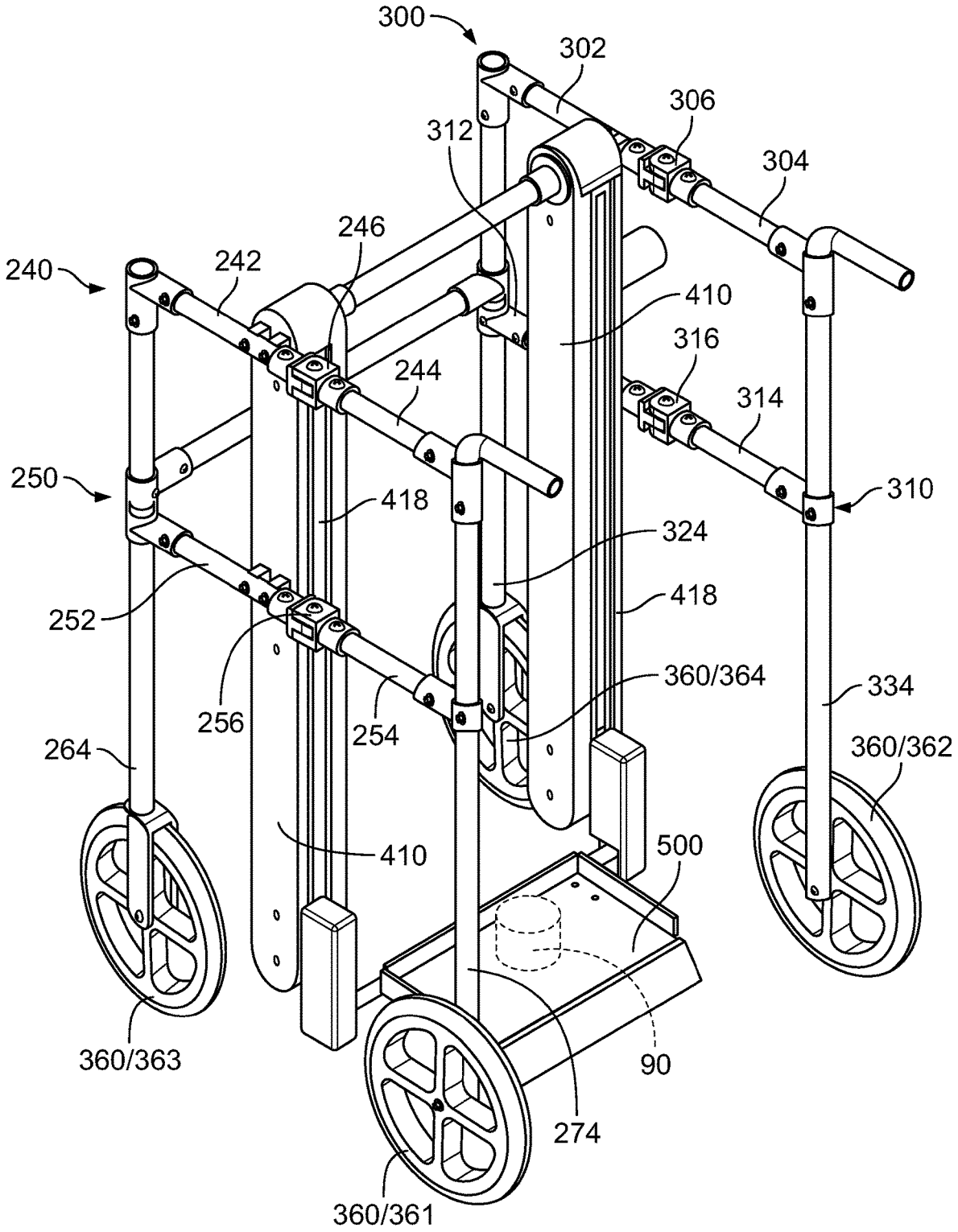
FIG. 3 is a perspective back view of the frame (210) with the platform (500) in a folded-down orientation

The locking articulated joint (236) allows the first part (232) and the second part (234) to rotate about the vertical axis (238) of the locking articulated joint (236), rotating from an extended orientation to a folded orientation. In an extended orientation, the first part (232) and the second part (234) share the same central axis, so that the horizontal support (230) lies on a straight line. In a folded orientation, the first part (232) is perpendicular to the second part (234). FIG. 3 shows the horizontal supports (230) of the first side section (220) in an extended orientation.

The locking articulated joints (236) allows a portion of the first side section (220) to be folded inwardly towards the central longitudinal plane (212-YZ) of the frame (210).

Figure 6:
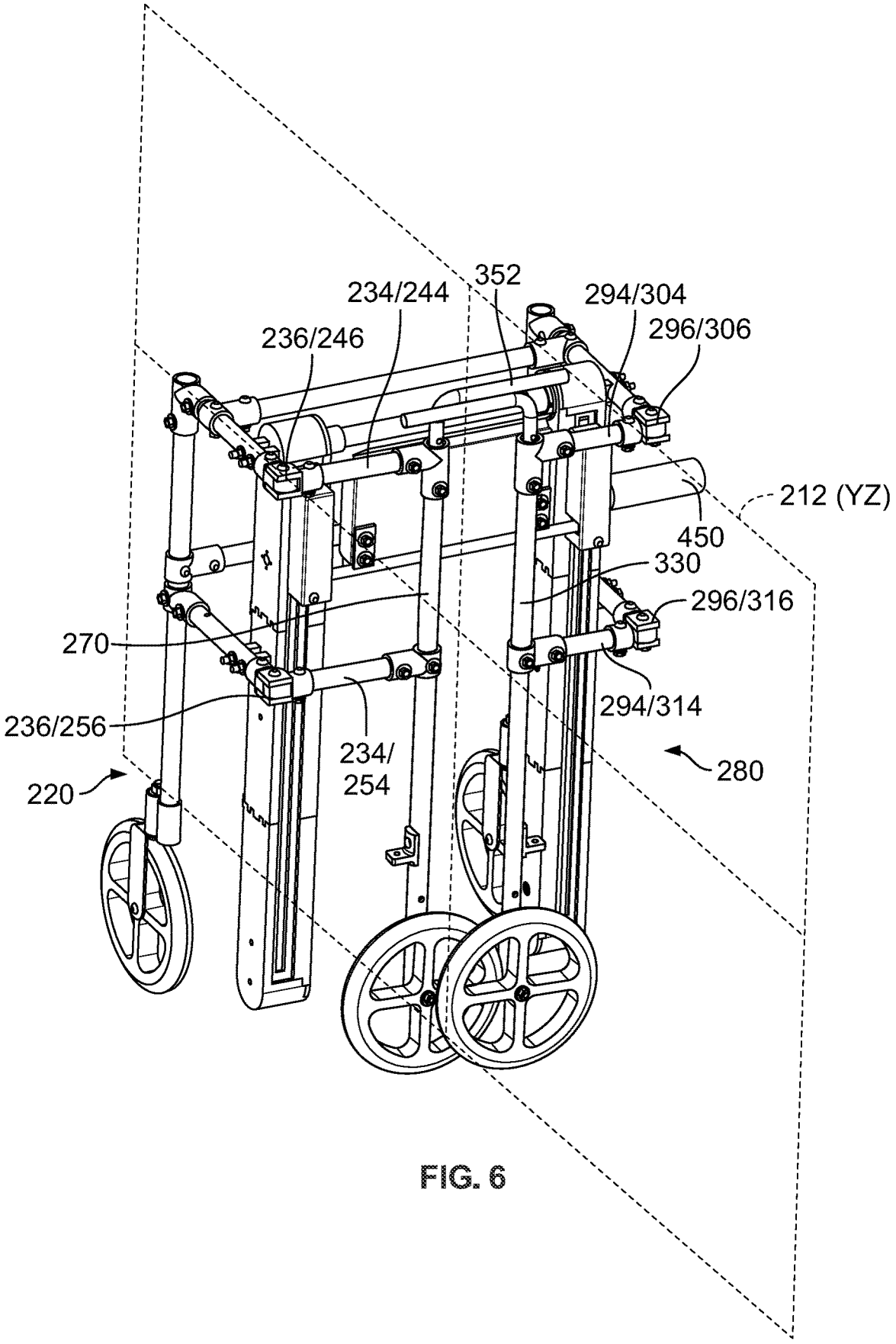
FIG. 6 is a perspective back view of the frame (210) with a portion of the first side section (220) and a portion of the second side section (280) in a folded orientation

When the second parts (234) of the horizontal supports (230) are rotated about the vertical axis (238) of the locking articulated joints (236), the second parts (234) of the horizontal supports (230), the back vertical support (270), and the first handle (352) fold inwardly towards the central longitudinal plane (212-YZ) of the frame (210) to a folded orientation. The locking articulated joints (236) can be locked into place either in the extended orientation or in a folded orientation. FIG. 6 shows a portion of the first side section (220) folded inwardly towards the central longitudinal plane (212-YZ) of the frame (210), in a folded orientation.

From the folded orientation, the second parts (234) of the horizontal supports (230), the back vertical support (270), and the first handle (352) can fold outwardly from the central longitudinal plane (212-YZ) of the frame (210) back to an extended orientation. FIG. 2 shows the second parts (234) of the horizontal supports (230), the back vertical support (270), and the first handle (352) in an extended orientation.

In one embodiment, the first side section (220) comprises a top horizontal support (240) and a bottom horizontal support (250). The top horizontal support (240) comprises a locking articulated joint (246), a first part (242) and a second part (244). The bottom horizontal support (250) comprises a locking articulated joint (256), a first part (252) and a second part (254). FIG. 3 shows a first side section (220) with a top horizontal support (240) and a bottom horizontal support (250).

1.3 Second Side Section (280)

The second side section (280) comprises one or more horizontal supports (290), a front vertical support (320) and a back vertical support (330).

The front vertical support (320) may comprise a top end (322) and a bottom end (324). The back vertical support (330) may comprise a top end (332) and a bottom end (334).

The one or more horizontal supports (290) attach the front vertical support (320) to the back vertical support (330). Each of the one or more horizontal supports (290) comprises a locking articulated joint (296), a first part (292) and a second part (294). The first part (292) is attached to the locking articulated joint (296) and the front vertical support (320). The second part (294) is attached to the locking articulated joint (296) and the back vertical support (330). FIG. 2 shows a second side section (280) with two horizontal supports (290).

The locking articulated joint (296) allows the first part (292) and the second part (294) to rotate about the vertical axis (298) of the locking articulated joint (296), rotating from an extended orientation to a folded orientation and vice versa. In an extended orientation, the first part (292) and the second part (294) share the same central axis, so that the horizontal support (290) lies on a straight line. In a folded orientation, the first part (292) is perpendicular to the second part (294). FIG. 3 shows the horizontal supports (290) of the second side section (280) in an extended orientation.

The locking articulated joint (296) allows a portion of the second side section (280) to be folded inwardly towards the central longitudinal plane (212-YZ) of the frame (210). When the second parts (294) of the horizontal supports (290) are rotated about the vertical axis (298) of the locking articulated joints (296), the second parts (294) of the horizontal supports (290), the back vertical support (330) and the second handle (354) fold inwardly towards the central longitudinal plane (212-YZ) of the frame (210) to a folded orientation. The locking articulated joints (296) can be locked into place either in the extended orientation or in a folded orientation. FIG. 6 shows a portion of the second side section (280) folded inwardly towards the central longitudinal plane (212-YZ) of the frame (210), in a folded orientation.

From the folded orientation, the second parts (294) of the horizontal supports (290), the back vertical support (330), and the second handle (354) can fold outwardly from the central longitudinal plane (212-YZ) of the frame (210) back to an extended orientation. FIG. 2 shows the second parts (294) of the horizontal supports (290), the back vertical support (330), and the second handle (354) in an extended orientation.

In one embodiment, the second side section (280) comprises a top horizontal support (300) and a bottom horizontal support (310). The top horizontal support (300) comprises a locking articulated joint (306), a first part (302) and a second part (304). The bottom horizontal support (310) comprises a locking articulated joint (316), a first part (312) and a second part (314). FIG. 3 shows the second side section (280) with a top horizontal support (300) and a bottom horizontal support (310).

1.4 Cross Bars (340)

The one or more cross bars (340) attach the first side section (220) to the second side section (280). In one embodiment, there are two cross bars (340)—a first cross bar (342) and a second cross bar (344). FIG. 9 shows a frame (210) with two cross bars (340)—a first cross bar (342) and a second cross bar (344).

2 Handles (350)

Handles (350) allow the user to grip and to control the Platform-Lift Walker (100). A first handle (352) is attached to the top end of the back vertical support (270) of the first side section (220). A second handle (354) is attached to the top end of the back vertical support (330) of the second side section (280). FIG. 1 shows a first handle (352) attached to the top end (272) of the back vertical support (270) of the first side section (220) and a second handle (354) attached to the top end (332) of the back vertical support (330) of the second side section (280).

Figure 10:
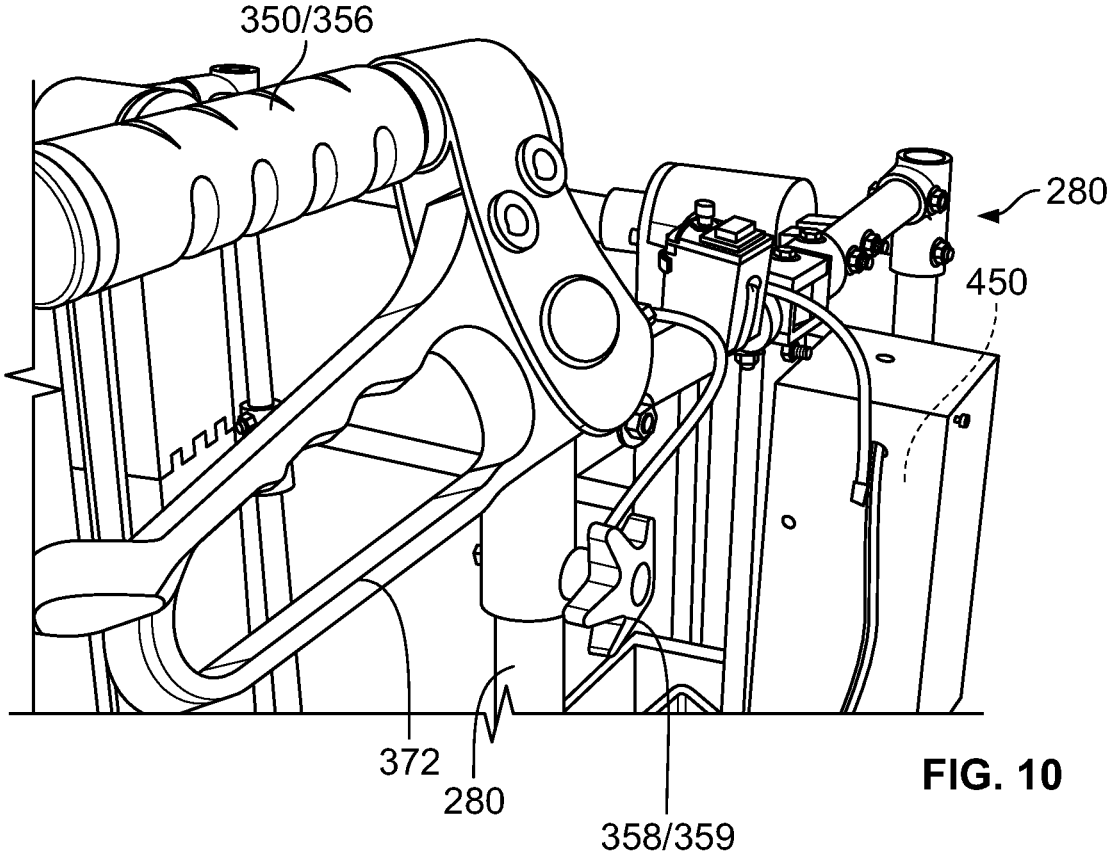
FIG. 10 is a close up view from the back side of the second side section (280) of the Platform-Lift Walker (100)

The handles (350) may telescope, raising and lowering the height of the handles (350). The telescoping handles (356) are adjusted to ensure an optimal height and ergonomic fit for the user. FIG. 10 shows a telescoping handle (356) attached to the top end (332) of the back vertical support (330) of the second side section (280).

The telescoping handles (356) may further comprise a means for locking the telescoping handle (358). The means for locking the telescoping handle (358) allows a telescoping handle and a back vertical support to become rigidly locked together against vertical displacement. The means for locking the telescoping handle (358) can be any state of the art locking mechanisms utilized to lock telescoping poles, rods, and tubes. These locking mechanisms include thumb screws (359), clutch locks, split collar locks, snap locks, snap and spring button locks, cam locks, spring button locks, spring button clutch locks, snap lock, set knob lock, mini-economy lock, swaging, retaining pins, knurled screw, among others. See generally https://www.testriteoem.com. FIG. 10 shows a means for locking the telescoping handle (358) as a thumb screw (358).

2.1 Wheels (360)

The walker (200) comprises two or more wheels (360). Because the Platform-Lift Walker (100) is designed for users with limited vertical and horizontal mobility, the walker (200) may comprise four wheels (360), located at the four corners of the Platform-Lift Walker (100). The wheels (360) complements the needs of the limited vertical and horizontal mobility user, especially if the user is moving the Platform-Lift Walker (100) with an object (90) over the platform (500).

Wheels (360) are operatively connected to the bottom ends of the vertical supports. The wheels maybe operatively connected to rotate or not to rotate with respect to the vertical supports. A first wheel (361) maybe mounted on the bottom end (274) of the back vertical support (270) of the first side section (220). A third wheel (363) maybe mounted on the bottom end (264) of the front vertical support (260) of the first side section (220).

A second wheel (362) maybe mounted on the bottom end (334) of the back vertical support (330) of the second side section (280). A fourth wheel (364) maybe mounted on the bottom end (324) of the front vertical support (320) of the second side section (280).

FIG. 3 shows four wheels (360) mounted on the bottom ends of the vertical supports.

2.2 Wheel Locking System (370)

The walker (200) comprises one or more wheel locking systems (370). A wheel locking system (370) allows the user to slow down the Platform-Lift Walker (100) and to lock a wheel (360) in place. Wheel locking allows for a safer operation of the Platform-Lift Walker (100) by the user. Locking one or more wheels (360) in place is necessary to provide stability while the platform (500) is driven along vertically. One wheel locking system (370) is corresponds to each wheel (360) that needs to be locked in place. The wheel locking system (370) attaches to the frame (210) of the walker (200).

Figure 13:
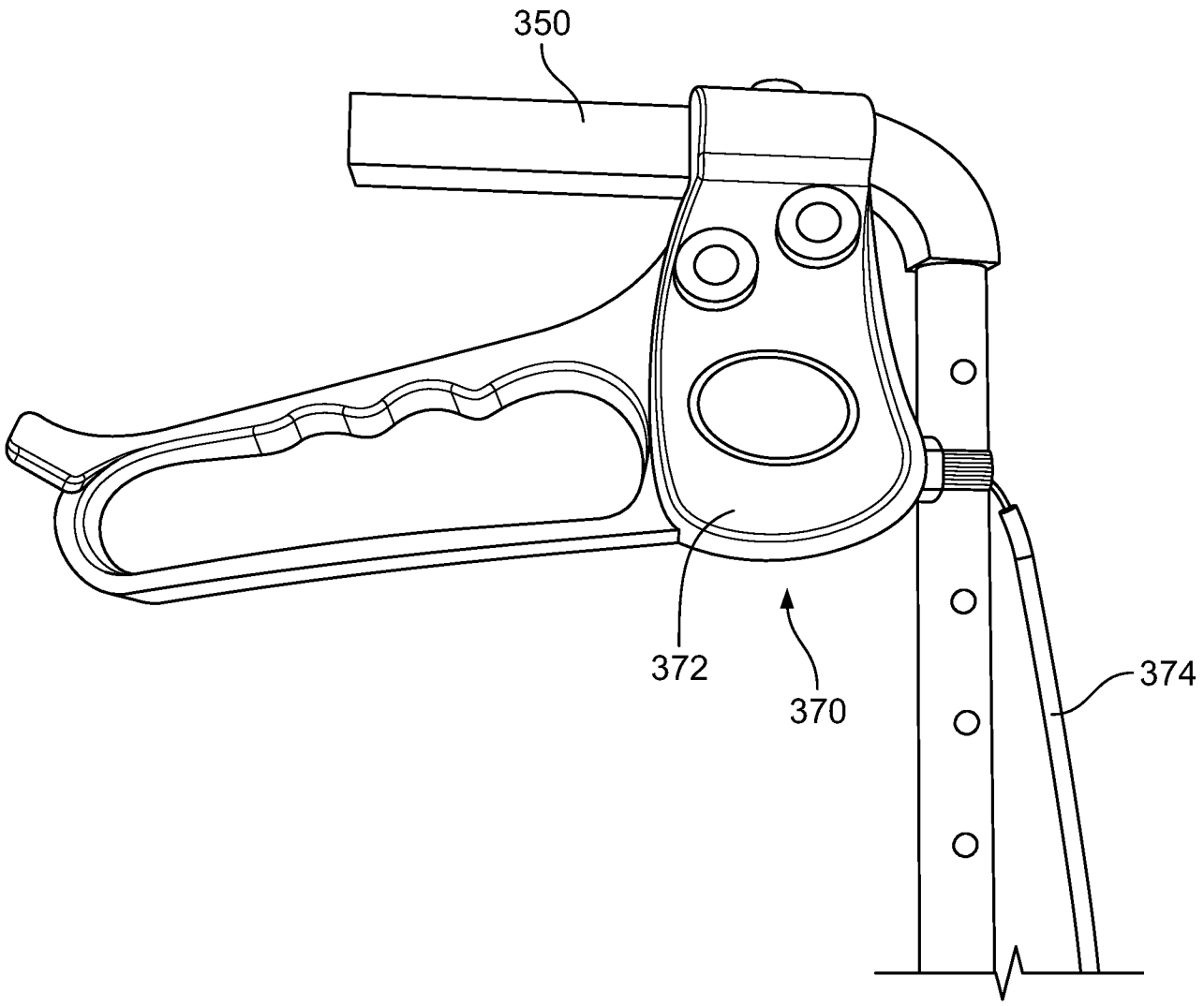
FIG. 13 is a side view of some of the elements of the wheel locking system (370). A lever (372) is attached to a handle (350), and a cable (374) is operatively connected to the lever (372)

The wheel locking system (370) comprises a lever (372), a cable (374), and a brake (376). The cable (374) operatively connects the lever (372) to the brake (376). The lever (372) attaches to the handle (350). The brake (376) attaches to the frame (210). The brake (376) is operatively connected to a wheel (360): when the lever (372) is activated, the cable (374) and the brake (376) are engaged, and the brake (376) presses against the wheel (360). The brake (376) slows down the Platform-Lift Walker (100). When the lever (372) is further activated, the cable (374) and the brake (376) are engaged so that the brake (376) locks the wheel (360) in place, preventing further movement. FIG. 13 is a side view of some of the elements of the wheel locking system (370). A lever (372) is attached to a handle (350), and a cable (374) is operatively connected to the lever (372).

In one embodiment, the walker (200) comprises two wheel locking systems (370); a first wheel locking system (380) and a second wheel locking system (390). The first wheel locking system (380) comprises a lever (382), a cable (384) and a brake (386). The cable (384) is operatively connected to the lever (382) and the brake (386). The lever (382) is attached to the first handle (352). The brake (386) is operatively connected the first wheel (361) and to the frame (210). The second wheel locking system (390) comprises a lever (392), a cable (394) and a brake (396). The cable (394) is operatively connected to the lever (392) and the brake (396). The lever (392) is attached to the second handle (354). The brake (396) is operatively connected to the second wheel (362) and to the frame (210).

In another embodiment, the walker (200) comprises one wheel locking system (370) that is attached to the frame (210) of the walker (200).

The brake (386) is any state of art wheel brake that can slow down and lock a wheel (360). These include but not are not limited to spoon brakes, duck brakes, rim brakes, disc brakes, drum brakes, coaster brakes, drag brakes and band brakes. Traditional walkers are fitted with a brake that provides direct friction to the wheel (360).

FIG. 9 shows a walker (200) with two wheel locking systems (370): a first wheel locking system (380) and a second wheel locking system (390).

3 Lifting Mechanism (400)

A lifting mechanism (400) drives the platform (500) along vertically, raising or lowering the platform (500). The lifting mechanism (400) is attached to the frame (210) of the walker (200).

The lifting mechanism (400) comprises one or more means for driving the platform along vertically (410), a prime mover (450), an energy storage device (460), a controller (470), and a plurality of sensors (480). The lifting mechanism (400) may further comprise a drive shaft (440). The drive shaft (440) operatively connects two or more means for driving the platform along vertically (410). When two or more means for driving the platform along vertically (410) are operatively connected, this allows force to be applied to multiple parts of the platform (500), allowing for a smoother movement. FIG. 9 shows a lifting mechanism (400) comprising of two means for driving the platform along vertically (410), a drive shaft (440), a prime mover (450) (not shown), an energy storage device (460), a controller (470), and a plurality of sensors (480) (not shown).

The platform (500) is rotatably attached to the lifting mechanism (400), specifically to the one or more means for driving the platform along vertically (410).

3.1 Means for Driving the Platform Along Vertically (410)

The means for driving the platform along vertically (410) comprises a housing (418) and a drive mechanism (420). The drive mechanism (420) is attached to the housing (418). The drive mechanism (420) maybe any kind of drive mechanism suitable for driving the platform (500) along vertically, such as rack/pinion, gears, screws, pulleys with belts/chains, and linear actuators.

Figure 7:
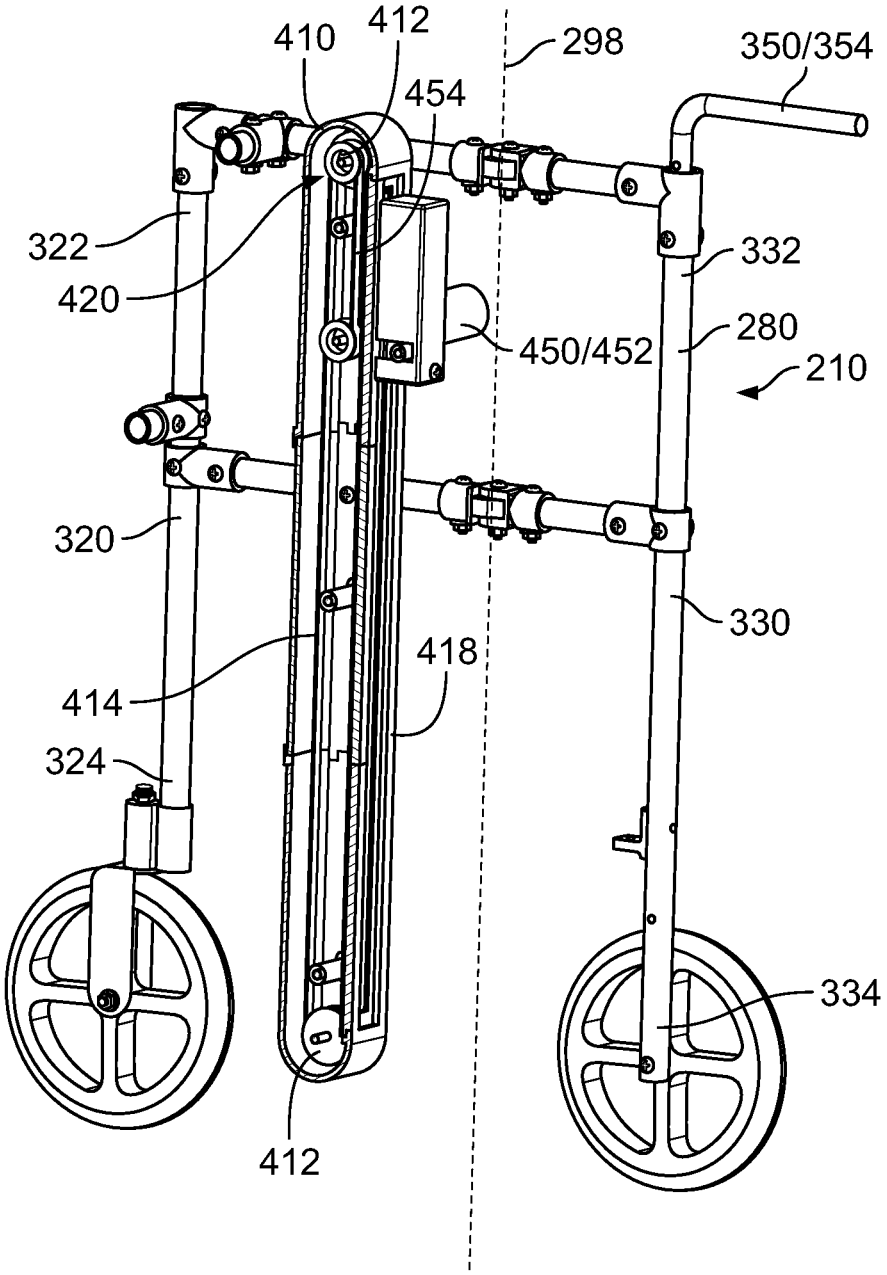
FIG. 7 is a cross section of the means for driving the platform along vertically (410) attached to the second side section (280) of the frame (210)
Figure 8:
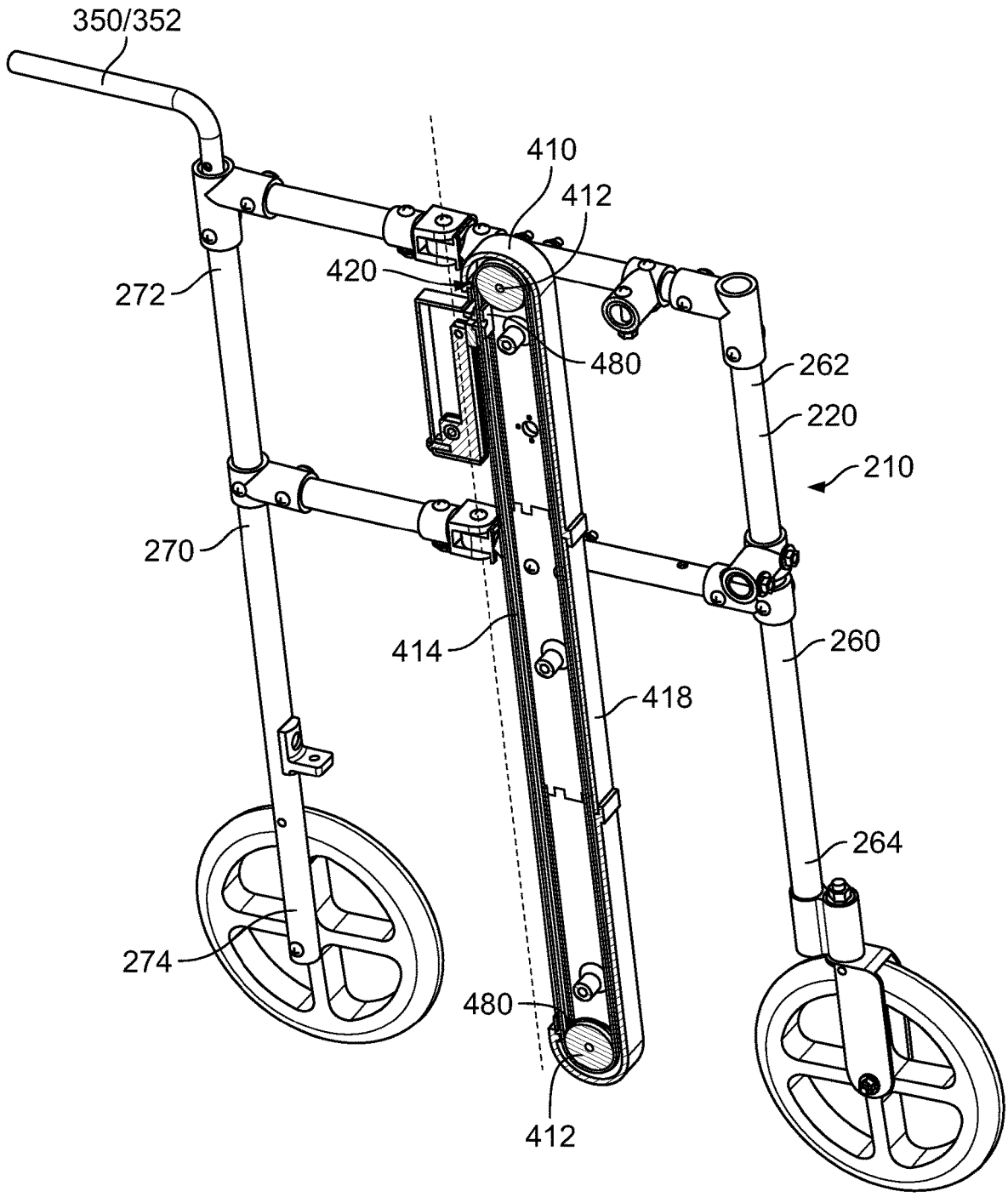
FIG. 8 is a cross section of the means for driving the platform along vertically (410) attached to the first side section (220) for the frame (210)

A pulley with belt/chain drive mechanism comprises two or more pulleys (412) and one or more belts/chains (414). The belt/chain (414) is looped around two pulleys (412). Different combinations of two or more pulleys (412) and one or more belts/chains (414) may be assembled depending on the force, torque, and power sources and requirements. FIG. 7 shows a cross section of the means for driving the platform along vertically (410) attached to the second side section (280) of the frame (210). FIG. 8 shows a cross section of the means for driving the platform along vertically (410) attached to the first side section (220) for the frame (210).

A linear actuator includes mechanical actuators, hydraulic actuators, pneumatic actuators, piezoelectric actuators, twisted and coiled polymer (TCP) actuators, electro-mechanical actuators, linear motors, and telescoping linear actuators.

When an electro-mechanical actuator is used, a variety of rotary motor prime movers may be used, including stepper motors.

The housing (418) partially encloses the drive mechanism (420) from the outside environment and provides support for the drive mechanism (420).

3.2 Drive Shaft (440)

A drive shaft (440) transfers power equally to the two or more means for driving the platform along vertically (410). A common drive shaft (440) is important to ensure that equal force is delivered to the platform remains horizontal during operation when two or more means for driving the platform along vertically (410) exist. A common drive shaft (440) ensures that the same amount of force is directed to the means for driving the platform along vertically (410). The drive shaft (440) operatively connects two or more means for driving the platform along vertically (410). FIG. 2 shows two means for driving the platform along vertically (410) operatively connected by a drive shaft (440).

3.3 Prime Mover (450)

A prime mover (450) is a machine designed to convert one form of energy into mechanical energy. The prime mover (450) provides the mechanical energy to drive the platform (500) along vertically, either raising or lowering the platform (500). The lifting mechanism (400) can utilize any kind of prime mover (450) such as electro-mechanics, pneumatics, hydraulics to provide linear motion to drive the platform along vertically, either raising or lowering the platform (500).

When electro-mechanic prime movers (452)—electric motors—are utilized, a variety of rotary motor prime movers may be used, including stepper motors.

The prime mover (450) is operatively connected to the energy storage device (460). The prime mover (450) is operatively connected to one or more of the means for driving the platform along vertically (410). This can be achieved through a belt/chain (454), cable, gear or any other suitable element that can operatively connect the prime mover (450) to one or more of the means for driving the platform along vertically (410). For example, a belt/chain (454) can operatively connect the prime mover (450) to the means for driving the platform along vertically (410). FIG. 7 shows a prime mover (450) operatively connected to a means for driving the platform along vertically (410) by a belt/chain (454). The means for driving the platform along vertically (410) is attached to the second side section (280).

3.4 Energy Storage Device (460)

An energy storage device (460) provides the energy and power needed to operate the prime mover (450). The lifting mechanism's prime mover (450) is preferably battery powered—an electrochemical stored energy device—although other energy storage devices (460) can be used. When the lifting mechanism's prime mover (450) is battery powered, the batteries should have enough energy capacity for the Platform-Lift Walker (100) to be utilized for a predetermined period before charging is required. The energy storage device (460) is operatively connected to the prime mover (450), supplying the energy needed to move the prime mover (450). The energy storage device (460) is operatively connected to the controller (470).

For example a battery may have enough energy capacity, based on a predetermined usage profile, so that the battery does not have to be charged for one day, two days, or a week. The battery may have fast charging capabilities. FIG. 9 shows the energy storage device (460) operatively connected to the prime mover (450) and the controller (470).

3.5 Controller (470)

Figure 11:
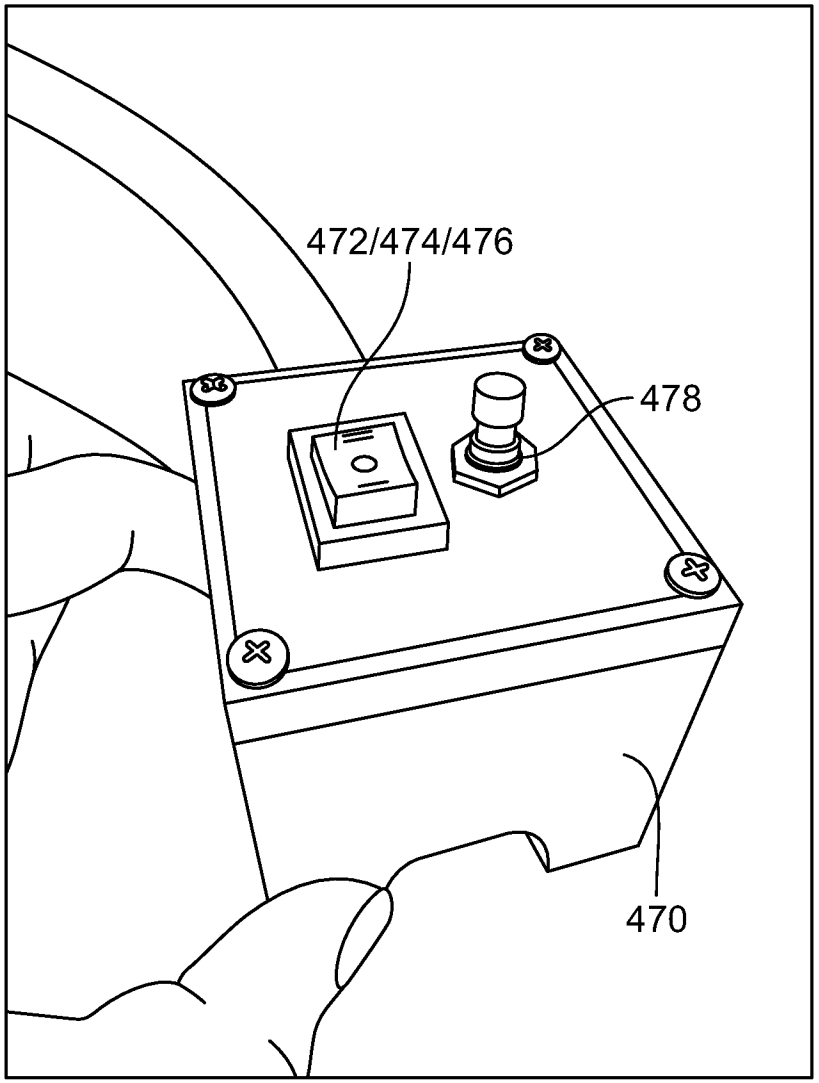
FIG. 11 is a close up view of the controller (470) comprising an up/down/off input device (472) and an emergency shut off input device (478)

The lifting mechanism (400) comprises a controller (470). The controller (470) is a computer assembly that comprises hardware and software components that directs the vertical (raising, lowering, off) movement of the platform (500) using input and output data. The controller (470) comprises an up/down/off input device (472) that includes but is not limited to switches (474), (including rocker switches (476)), buttons, optical sensors, keyboards, and joysticks. This up/down/off input device (472) allows the user to direct up, down, and off commands. FIG. 11 shows a controller (470)

Figure 12:
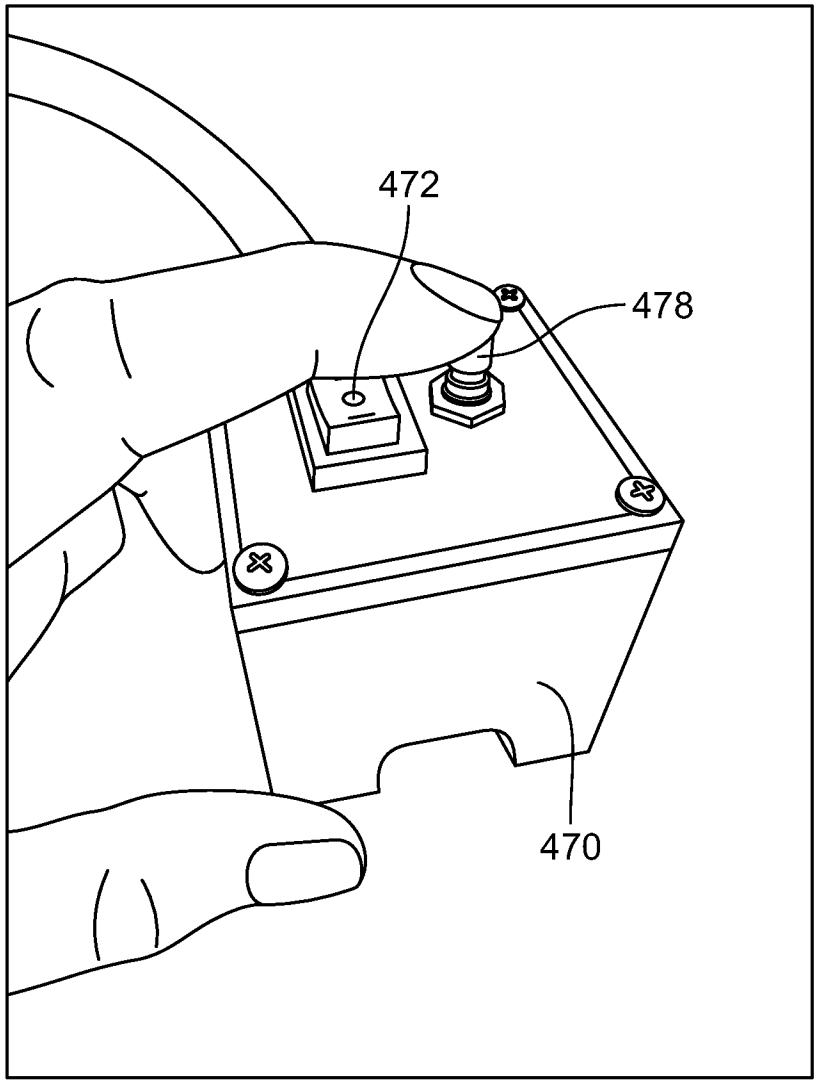
FIG. 12 is a close up view of the controller (470) comprising an up/down/off input device (472) and an emergency shut off input device (478), being activated by a user

The controller (470) may further comprise an emergency shut off input device (478). This device is typically a button (479), but any other type of suitable input device may be utilized. FIG. 12 show a user pressing the emergency shut off input device (478).

The controller (470) is attached to the frame (210) of the walker (200) within easy reach of the user's hands as the user operates the walker (200). The controller (470) is operatively connected to the energy storage device (460), prime mover (450), and the sensors (480).

3.6 Sensors (480)

One or more sensors (480) are attached to each means for driving the platform along vertically (410) to detect the platform (500) and stop the platform (500) when the platform (500) reaches a predetermined ground minimum height (480) and/or when the platform (500) reaches a predetermined waist high (typically 30 to 36 inches) maximum height. For example, a sensor (480) may attached to the bottom of the means for driving the platform along vertically (bottom positioned sensor) (410) and a sensor (480) maybe attached to the top of the means for driving the platform vertically (410) (top positioned sensor). FIG. 8 shows the relative positioning of two sensors (480) attached to the means for driving the platform along vertically (410) attached to the first side section (220) of the frame (210). The sensors may be attached to the housing (418) of the means for driving the platform along vertically (410).

The sensors (480) stop the motion of the prime mover (450) when the sensors (480) detect the proximity of the platform (500). Stop time after the sensors (480) detect the proximity of the platform (500) must be reasonable enough to avoid damage to the prime mover (450). The sensors (480) are operatively connected to the controller (470). For example, the sensors (480) maybe hall effect sensors.

3.7 Assembly Instructions

In one embodiment of the lifting mechanism (400), the lifting mechanism (400) comprises one means for driving the platform along vertically (410), a prime mover (450), an energy storage device (460), a controller (470), and a plurality of sensors (480). The prime mover (450) is operationally connected to the means for driving the platform along vertically (410). The means for driving the platform along vertically (410) is attached to the frame (210).

In another embodiment of the lifting mechanism (400), the lifting mechanism (400) comprises two means for driving the platform along vertically (410), a drive shaft (440), a prime mover (450), an energy storage device (460), a controller (470), and a plurality of sensors (480). The prime mover (450) is operatively connected to one of the means for driving the platform along vertically (410). The two means for driving the platform along vertically (410) are operatively connected by the drive shaft (440). The two means for driving the platform along vertically (410) are attached to the frame (210). For example, one of the means for driving the platform along vertically (410) maybe attached to the first side section (220), and the other means for driving the platform along vertically (410) maybe attached to the second side section (280). FIG. 2 shows one means for driving the platform along vertically (410) attached to the first side section (220), and another means for driving the platform along vertically (410) attached to the second side section (280).

4 Platform (500)

Figure 5:
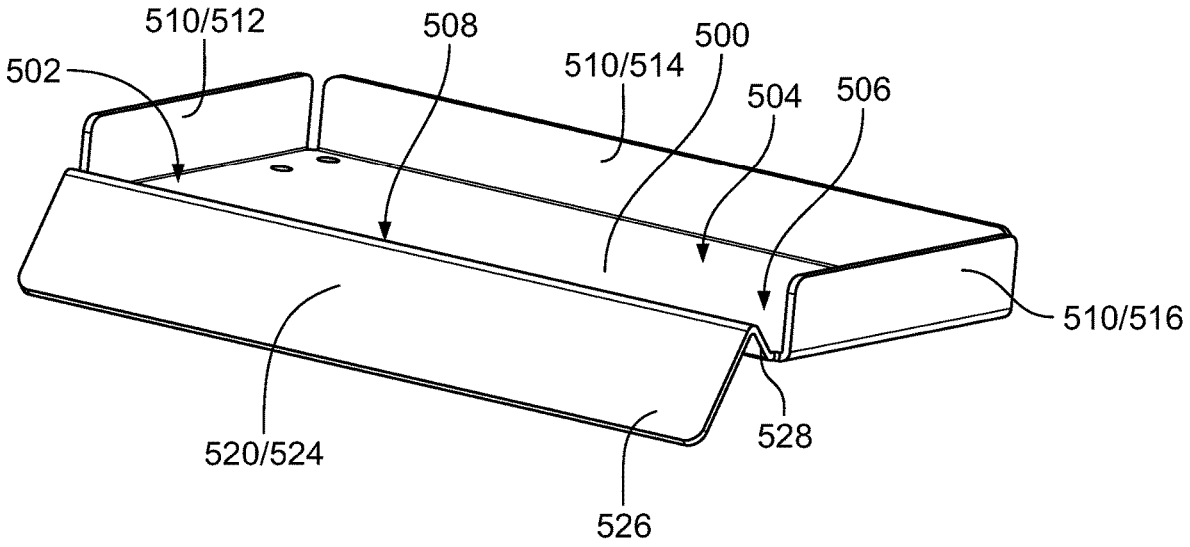
FIG. 5 is a perspective front view of the platform (500) with a v-shaped lip (524)

The platform (500) comprises a first side (502), a second side (504), a third side (506) and a fourth side (508). Objects (90) can be placed over the platform (500), so that the objects (90) lie over the platform (500). FIG. 5 shows a platform (500). The platform (500) is rotatably attached to the lifting mechanism (400), specifically to the one or more means for driving the platform along vertically (410). FIG. 3 is a perspective front view of the frame (210), two means for driving the platform along vertically (410), and a platform (500), where the platform (500) is rotatably attached to the two means for driving the platform along vertically (410); an object (90) lies over the platform (500).

4.1 Walls (510)

The platform (500) may further comprise a plurality of walls (510). The walls (510) prevent the objects (90) from sliding or rolling off the platform (500) as the platform (500) is driven along vertically. In one example, the platform may further comprise a first wall (512), a second wall (514), and a third wall (514). The second wall (514) maybe joined to the first wall (512) and the third wall (514). The first wall (512) is joined to the first side (502) of the platform (500); the second wall (514) is joined to the second side (504) of the platform (500) and the third wall (516) is joined to the third side (506) of the platform (500). The fourth side (508) is not joined to a wall (510) and is used as the entry area to slide objects (90) over the platform (500). FIG. 5 shows a platform (500) with a plurality of walls (510).

4.2 Folded-Up and Folded-Down Orientations

The platform (500) can be deployed in two main orientations: folded-up and folded-down. In a folded-up orientation, the platform (500) is oriented substantially perpendicularly to the ground (+1-10 degrees). FIG. 1 is a perspective back view of the Platform-Lift Walker (100) with the platform (500) in a folded-up orientation. When the platform (500) is not being used to lift the objects (90), the platform (500) is normally stored in the folded-up orientation so that the platform (500) does not interfere with the forward and backward mobility of the user as the user uses the Platform-Lift Walker (100) as a regular walker. FIG. 3 is a perspective back view of the Platform-Lift Walker (100) with the platform in a folded-down orientation. When the user utilizes the Platform-Lift Walker (100) to lift the objects (90), the user folds the platform (500) to its folded-down orientation. In a folded-down orientation, the platform (500) is oriented substantially parallel to the ground (+1-10 degrees), allowing objects (90) to be placed over the platform (500).

The platform (500) is rotatably attached to the lifting mechanism (400). This rotatable attachment allows the platform (500) to be folded from its folded-up orientation to its folded-down orientation. This rotatable attachment also allows the platform (500) to be folded from its folded-down orientation to its folded-up orientation.

4.3 Lip (520)

The platform (500) may further comprise a lip (520). The lip (520) is joined to the fourth side (508) of the platform (500). The lip (520) can either be integrally joined to the platform (500) or it can be a discrete element that is joined to the fourth side (508) of the platform (500). When the lip (520) is a discrete element, preferred materials include rubber and plastic. FIG. 5 shows platform (500) with a lip (520).

The lip (520) may be flat, conforming to the surface of the ground when the platform (500) is has been lowered and placed in its folded down position. This helps the movement of small sized objects (90) over the platform (500).

The lip (520) may be V-shaped (524), where the lip (520) comprises a front slanted surface (526) and a back slanted surface (528). The V-shape allows for objects (90) to be slid over the V-shaped lip (524) to be placed over the platform (500). The V-shaped lip (524) prevents the objects (90) from sliding out of the platform (500) when the platform (500) is driven along vertically. FIG. 5 shows a platform (500) with a V-shaped lip (524).

4.4 Mat (530)

The Platform-Lift Walker (100) may further comprise a mat (530). The mat (530) is designed to be placed over the platform (500) and be removed from the platform (500). This allows for customization of the platform (500) functionality.

Figure 4:
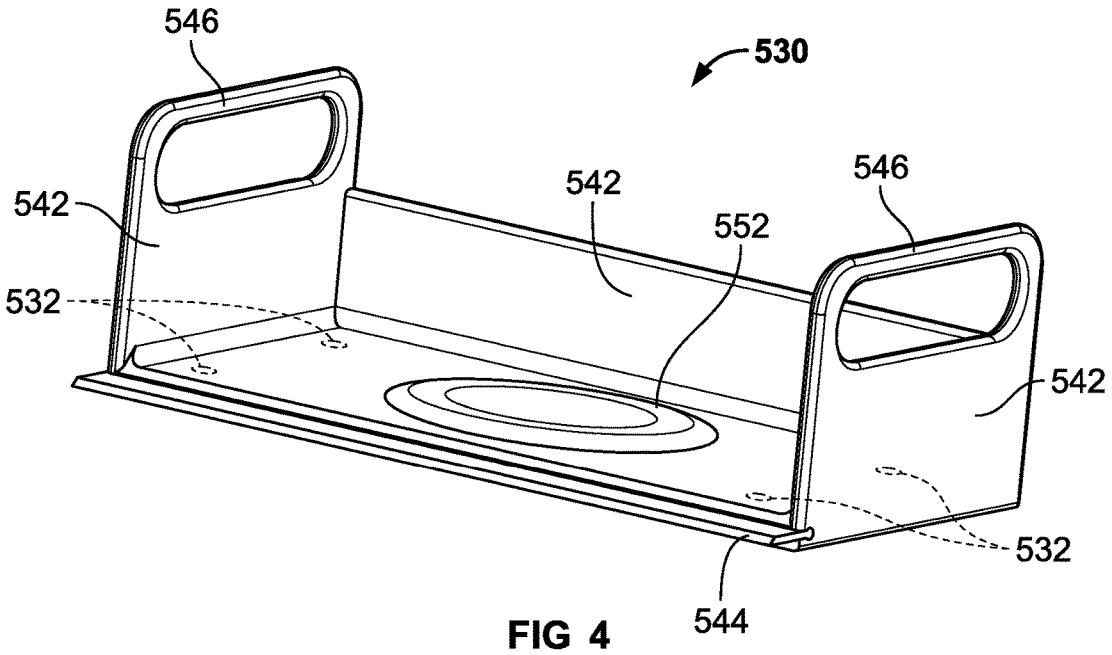
FIG. 4 is a perspective front view of a mat (530) with handles (546)

The mat (530) may be designed to have objects (90) swept over the mat (430). The mat (530) may have a slick or smooth texture that assists with the sweeping of objects (90) over the mat (530). The mat (530) may have raised edges or walls (542) to help contain the objects (90) once they have been swept over the mat (530). The mat (530) may have a lip (544) that helps with the sweeping of objects over the mat (530). FIG. 4 shows a mat (530) with a lip (544). The mat (530) may have handles (546) that help load the mat (530) over the platform (500). FIG. 4 shows a mat (530) with handles (546).

The mat (530) may be designed to accommodate heavy objects (90) and to prevent objects (90) to slide easily when the platform (500) is driven along vertically or when the Platform-Lift Walker (100) moves forward or backward. The mat (530) may further comprise one or more protrusions (552) that prevent these objects (90) from sliding or rolling off the mat (530) once the objects (90) have been placed over the mat (530) and the platform (500). Example of such a protrusion (552) includes a ring for round items. This ring maybe permanent or removable. A ring would have the capability, for example, depending of the size, to carry a cup or a watermelon. The ring maybe foldable. Other types of protrusions (552) include walls, bumps, divots, ridges, and angled edges. FIG. 4 shows a mat (530) with an elliptical protrusion.

The mat (530) may be fastened to the platform (500) by one or more fastener (532) or by surface friction. Examples of the one or more fasteners (532) include buttons, Velcro, zippers, adhesive, clips, clamps, and screws. FIG. 4 shows a mat (530) with four fasteners (532) attached to the bottom surface of the mat.

The mat (530) may be made of any suitable material, but preferably rugged and water proof. One example is a mat (530) made from rubberized material.

5 Accessories (600)

Figure 14:
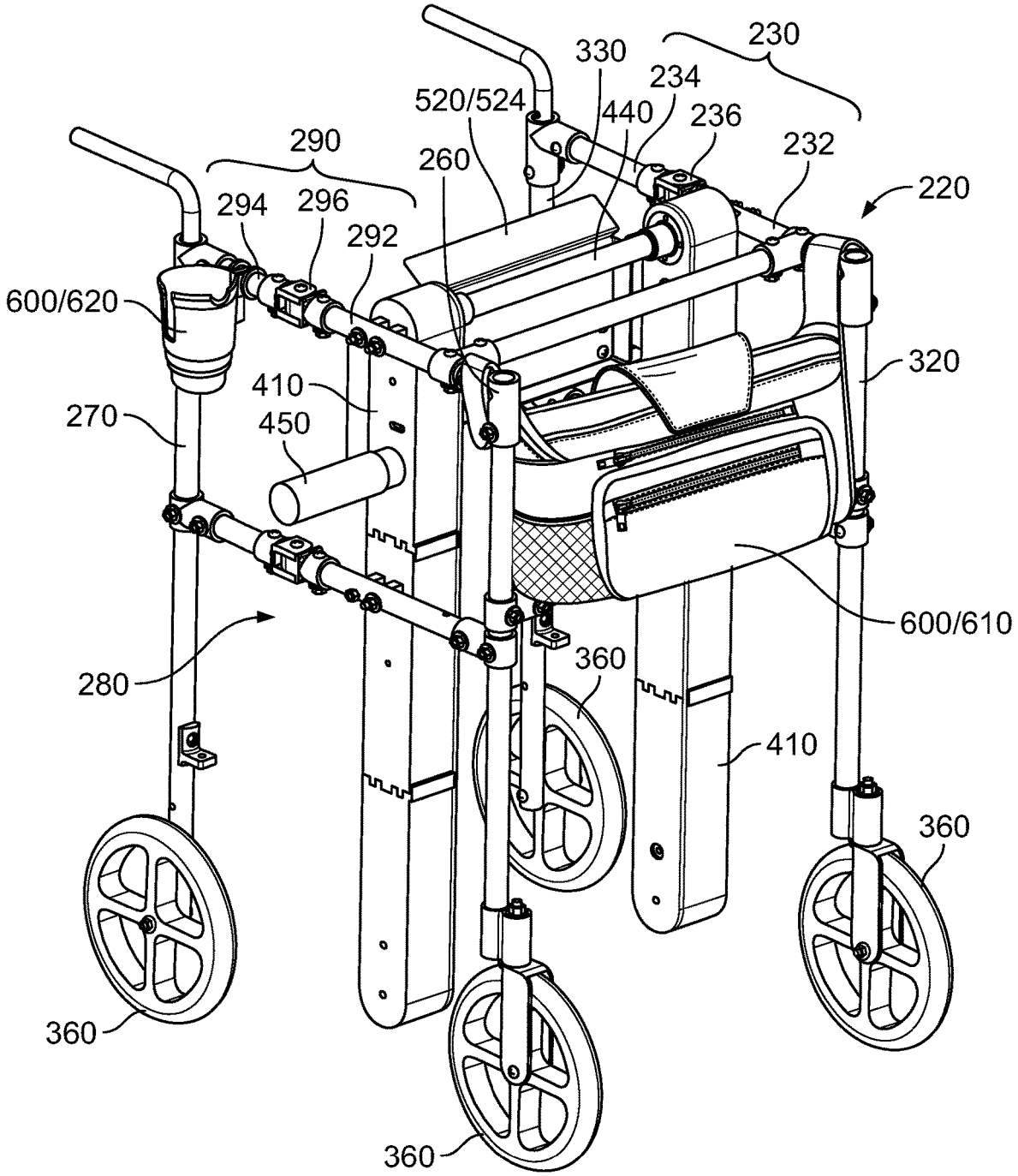
FIG. 14 is a perspective front view of the frame (210) showing two types of accessories (600) attached to the frame (210): a hanging pouch (610) and a water bottle carrier (620)

A variety of accessories may be attached to the frame (210). For example, a hanging pouch (610) may be fastened to the frame (210). A typical size of the hanging pouch is 12" long by 8" wide to carry light weight items. For example a water bottle carrier (620) may be fastened to the frame (210). FIG. 14 is a perspective front view of the frame (210) showing two types of accessories (600) attached to the frame (210): a hanging pouch (610) and a water bottle carrier (620).

6 Additional Comments

While the foregoing written description of the invention enables a person having ordinary skill in the art to make and use what is considered presently to be the best mode thereof, those of ordinary skill in the art will understand and appreciate the existence of variations, combinations, and equivalents of the specific embodiment, process, and examples herein. The invention should therefore not be limited by the above described embodiment, process, and examples, but by all embodiments and processes within the scope and spirit of the invention.

The invention claimed is:

1. A lifting aide device that allows the lifting of objects to and from the ground, the lifting aide device comprising:
- (a) a walker, the walker comprising:
  - (i) a frame;
  - (ii) a first handle and a second handle;
  - (iii) two or more of wheels;
  - (iv) two or more wheel locking systems, each wheel locking system comprising:
    - (1) a lever;
    - (2) a cable;
    - (3) a brake;
  - (v) where the two or more wheels are operatively connected to the frame,
  - (vi) where the first handle and the second handle are attached to the frame,
  - (vii) where the lever of each wheel locking system is attached to one of the handles,
  - (viii) where the brake of each wheel locking system is operatively connected to one of the wheels;
- (b) a platform;
- (c) a lifting mechanism, the lifting mechanism comprising:
  - (i) one or more means for driving the platform along vertically;
  - (ii) a prime mover;
  - (iii) an energy storage device;
  - (iv) a controller;
  - (v) a plurality of sensors;
  - (vi) where the prime mover is operatively connected to at least one of the means for driving the platform along vertically and to the energy storage device,
  - (vii) where the controller is operatively connected to the prime mover, the energy storage device, and the plurality of sensors,
- (d) where one or more sensors are attached to each of the one or more means for driving the platform along vertically,
- (e) where the lifting mechanism is attached to the frame of the walker,
- (f) where the platform is rotatably attached to the one or more means for driving the platform along vertically.

2. The lifting aide described in claim 1,
- (a) wherein the frame further comprises:
  - (i) a first side section;
  - (ii) a second side section;
  - (iii) one or more cross bars;
  - (iv) where the one or more cross bars attach the first side section of the walker to the second side section of the walker,
  - (v) where the first handle is attached to the first side section,
  - (vi) where the second handle is attached to the second side section.

3. The lifting aide described in claim 2,
- (a) wherein the first side section comprises:
  - (i) one or more horizontal supports;
  - (ii) a front vertical support;
  - (iii) a back vertical support;
  - (iv) where the first handle is attached to the back vertical support of the first side section,
- (b) wherein the second side section comprises:
  - (i) one or more horizontal supports;
  - (ii) a front vertical support; and
  - (iii) a back vertical support;
  - (iv) where the second handle is attached to the back vertical support of the second side section.

4. The lifting aide described in claim 3,
- (a) wherein the frame further comprises a imaginary central longitudinal plane;
- (b) wherein each of the one or more horizontal supports of the first side section comprises:
  - (i) a first part;
  - (ii) a second part;
  - (iii) a locking articulated joint; the locking articulated joint comprising a vertical axis;
  - (iv) where the first part is attached to the locking articulated joint and the front vertical support of the first side section,
  - (v) where the second part is attached to the locking articulated joint and the back vertical support of the first side section,
  - (vi) where each second part rotates about the vertical axis of the locking articulated joint, allowing each second part, the back vertical support of the first side section, and the first handle to fold inwardly towards the central longitudinal plane of the frame and to fold outwardly from the central longitudinal plane of the frame,
- (c) wherein each of the one or more horizontal supports of the second side section comprises:
  - (i) a first part;
  - (ii) a second part;
  - (iii) a locking articulated joint; the locking articulated joint comprising a vertical axis;
  - (iv) where the first part is attached to the locking articulated joint and the front vertical support of the second side section,
  - (v) where the second part is attached to the locking articulated joint and the back vertical support of the second side section, (vi) where each second part rotates about the vertical axis of the locking articulated joint, allowing each second part, the back vertical support of the second side section, and the second handle to fold inwardly towards the central longitudinal plane of the frame and to fold outwardly from the central longitudinal plane of the frame.

5. The lifting aide described in claim 4, (a) wherein the platform further comprises:

(i) a first side, a second side, a third side and a fourth side;

(ii) a first wall, a second wall, and a third wall;

(iii) where the first wall is joined to the first side of the platform, (iv) where the second wall is joined to the second side of the platform, (v) where the third wall is joined to the third side of the platform.

6. The lifting aide described in claim 5, (a) wherein the platform further comprises:

(i) a lip, (ii) where the lip is joined to the fourth side of the platform.

7. The lifting aide described in claim 6

(i) where the lip of the platform is V-shaped.

8. The lifting aide described in claim 4, (a) the lifting aide further comprising a mat;

(b) where the mat is placed over the platform.

9. The lifting aide described in claim 1, (a) the lifting aide further comprising a drive shaft;

(b) where there are at least two means for driving the platform along vertically, (c) where the drive shaft is operatively connected to the two or more means for driving the platform along vertically.

10. The lifting aide described in claim 9, (a) wherein the frame further comprises:

(i) a first side section;

(ii) a second side section;

(iii) one or more cross bars;

(iv) where the one or more cross bars attach the first side section of the walker to the second side section of the walker, (v) where the first handle is attached to the first side section, (vi) where the second handle is attached to the second side section.

11. The lifting aide described in claim 10, the (a) wherein the first side section comprises:

(i) one or more horizontal supports;

(ii) a front vertical support;

(iii) a back vertical support;

(iv) where the first handle is attached to the back vertical support of the first side section, (b) wherein the second side section comprises:

(i) one or more horizontal supports;

(ii) a front vertical support; and (iii) a back vertical support;

(iv) where the second handle is attached to the back vertical support of the second side section.

12. The lifting aide described in claim 11, (a) wherein the frame further comprises an imaginary central longitudinal plane;

(b) wherein each of the one or more horizontal supports of the first side section comprises:

(i) a first part;

(ii) a second part;

(iii) a locking articulated joint; the locking articulated joint comprising a vertical axis;

(iv) where the first part is attached to the locking articulated joint and the front vertical support of the first side section, (v) where the second part is attached to the locking articulated joint and the back vertical support of the first side section, (vi) where each second part rotates about the vertical axis of the locking articulated joint, allowing each second part, the back vertical support of the first side section, and the first handle to fold inwardly towards the central longitudinal plane of the frame and to fold outwardly from the central longitudinal plane of the frame, (c) wherein each of the one or more horizontal supports of the second side section comprises:

(i) a first part;

(ii) a second part;

(iii) a locking articulated joint; the locking articulated joint comprising a vertical axis;

(iv) where the first part is attached to the locking articulated joint and the front vertical support of the second side section, (v) where the second part is attached to the locking articulated joint and the back vertical support of the second side section, (vi) where each second part rotates about the vertical axis of the locking articulated joint, allowing each second part, the back vertical support of the second side section, and the second handle to fold inwardly towards the imaginary central longitudinal plane of the frame and to fold outwardly from the imaginary central longitudinal plane of the frame.

13. The lifting aide described in claim 12, (a) where the two or more wheels comprise a first wheel, a second wheel, a third wheel and a fourth wheel;

(b) where the first wheel is operatively connected to the back vertical support of the first side section, (c) where the second wheel is operatively connected to the back vertical support of the second side section, (d) where the third wheel is operatively connected to the front vertical support of the first side section, (e) where the fourth wheel is operatively connected to the front vertical support of the second side section, (i) where the two or more wheel locking systems comprise a first wheel locking system and a second wheel locking system, (ii) where the brake of the first wheel locking system is operatively connected to the first wheel, (iii) where the brake of the second wheel locking system is operatively connected to the second wheel.

14. The lifting aide described in claim 12, (a) wherein the platform further comprises:

(i) a first side, a second side, a third side and a fourth side;

(ii) a first wall, a second wall, and a third wall;

(iii) where the first wall is joined to the first side of the platform, (iv) where the second wall is joined to the second side of the platform, (v) where the third wall is joined to the third side of the platform.

15. The lifting aide described in claim 14, (a) wherein the platform further comprises:

(i) a lip, (ii) where the lip is joined to the fourth side of the platform.

16. The lifting aide described in claim 15

(i) where the lip of the platform is V-shaped.

17. The lifting aide described in claim 12, (a) the lifting aide further comprising a mat;

(b) where the mat is placed over the platform.

18. The lifting aide described in claim 17, (a) wherein the mat further comprises:

(i) a bottom surface; and (ii) one or more fasteners;

(b) where the one or more fasteners are attached to the bottom surface of the mat;

(c) where the one or more fasteners fastens the mat to the platform.

19. The lifting aide described in claim 12, the lifting aide further comprising:

(a) a hanging pouch;

(b) where the hanging pouch is attached to the frame of the walker.

* * * * *